United States Patent [19]

Durmann

[11] 4,065,057

[45] Dec. 27, 1977

[54] APPARATUS FOR SPRAYING HEAT RESPONSIVE MATERIALS

[76] Inventor: George J. Durmann, 97 Intervale Ave., Farmingdale, N.Y. 11735

[21] Appl. No.: 701,592

[22] Filed: July 1, 1976

[51] Int. Cl.[2] ..... B05B 7/16

[52] U.S. Cl. ..... 239/79; 239/133; 239/135; 239/425

[58] Field of Search ..... 239/133, 134, 135, 79, 239/425; 427/195, 422

[56] References Cited

U.S. PATENT DOCUMENTS

| | | | |
|---|---|---|---|
| 2,101,922 | 12/1937 | Stoesling | 239/133 X |
| 3,677,471 | 7/1972 | Deakin | 239/133 X |
| 3,958,758 | 5/1976 | Piorkowski | 239/133 |

FOREIGN PATENT DOCUMENTS

| | | | |
|---|---|---|---|
| 176,275 | 10/1953 | Austria | 239/133 |

*Primary Examiner*—Evon C. Blunk
*Assistant Examiner*—Michael Mar
*Attorney, Agent, or Firm*—Bauer, Amer & King

[57] ABSTRACT

In apparatus for spraying heat responsive materials, a serpentine path is provided so that a flow of compressed air or an inert gas first traverses the inside surface of the housing in order to maintain the outside surface of the apparatus in a relatively cool condition. The compressed air or inert gas continues to flow along its serpentine path, being gradually heated, and then is centrally discharged together with the material to be sprayed which may, for example, be a powder in the form of a pure resin or a mixture. In order to prevent "powder balling" or "spitting" of the resin as it is discharged, baffle means are provided surrounding the nozzle so that the heated compressed air or inert gas does not come into contact with the resin until it is in a mixing chamber that is downstream of and away from the nozzle.

19 Claims, 3 Drawing Figures

FIG. 3

APPARATUS FOR SPRAYING HEAT RESPONSIVE MATERIALS

BACKGROUND OF THE INVENTION

1. Field of the Invention

This invention relates generally to spray guns or the like and more particularly to apparatus for spraying heat responsive materials.

2. Description of the Prior Art

Spray guns, of the type to which the present invention is directed, have many applications and there are many examples of such apparatus in the prior art.

For example, in U.S. Pat. No. 2,878,063, granted on Mar. 17, 1959, to F. P. Kish et al, there is disclosed a resin spray gun defined by a body having separate, serpentine, resin and catalyst passageways as well as a separate air passage. Means are provided for heating materials within the resin and catalyst passageways and a nozzle is secured to the body in order to define a mixing chamber having an outlet orifice that communicates with the mixing chamber. The resin and catalyst passageways are connected to the mixing chamber at a position opposite the outlet orifice and a baffle is disposed in the mixing chamber for intimately intermixing the fluids passing therethrough. The baffle is in the form of a wire brush having bristles that extend transversely to the direction of fluid flow and which contact the wall of the mixing chamber. In the Kish et al patent, a passageway for cooling the interior surface of the housing is not provided nor are means provided for maintaining a separation at the exit plane of the nozzle of the heated air and the material that is to be sprayed together with its carrier.

In U.S. Pat. No. 2,362,634 granted on Nov. 14, 1944, to W. M. Houghton, there is disclosed a conventional spray gun having a barrel on which is placed a heating coil for heating the coating material as it passes through the spray gun. Under normal, intermittent conditions of use, there are many times when the Houghton spray gun would be idle. Consequently, if the same quantity of heat is applied to the spray gun when it is idle as is supplied to it when it is in operation to liquify a coating material during its passage through the spray gun, the temperature may build up to such an extent that, during the succeeding spraying operation, the coating material may be overheated and thus spoiled or the spray gun may be damaged. Houghton attempts to overcome these problems by providing a valve for controlling the flow of the coating material. The valve is operable because the heating means in the spray gun maintain a substantially uniform temperature in the chamber irrespective of whether the valve is open or closed. However, Houghton does not provide means for maintaining the body of the spray gun in a relatively cool condition and, moreover, does not provide means for shielding the nozzle from the direct flow of the heated air.

Still another example of the prior art in the field to which the present invention is directed is disclosed in U.S. Pat. No. 3,677,471 granted on July 18, 1972, to S. T. Deakin. This patent discloses an apparatus and method for coating surfaces with a continuous unitary film of polytetrafluoroethylene by spraying a heated stream of particles from the spray gun. A heater in the form of an electrical resistance unit is provided as well as a mixing chamber where gas is mixed with the particles. Means are also provided for directing a stream of gas through the guns to force the heated particles onto the surface to be coated. Specifically, Deakin discloses a conduit for delivering a mixture of polytetrafluoroethylene particles to the surface to be coated through a nozzle. A cylindrical tube is mounted around the conduit and an electrical resistance heater is positioned around the tube for heating the particles by radiation. A reservoir is provided for holding a quantity of these particles and the conduit is connected to the reservoir at a position adjacent the lower level of the particles. A pipe having an exit port is connected to the reservoir for forcing gas through the particles and means are also provided in the reservoir for agitating the particles. Deakin does not provide a stream of cooling gas directly against the interior surface of the housing in order to maintain the housing in a relatively cool condition, nor does Deakin provide any form of shield or baffle to divert the heated air from the exit plane of the nozzle.

U.S. Pat. No. 3,217,274, granted on Nov. 23, 1965 to A. Roche, discloses a radially symmetrical spray gun for paint having a nozzle that includes inner and outer passages for paint and compressed air, respectively. A central heating chamber is used containing electrical heating means that are connected to the outer passage with the electrical heating means being disposed below the nozzle. There is also provided a paint conduit connected to the inner passage that feeds paint in a thin stream under pressure through a tortuous path to the inner passage. Hot air is fed through a conduit that is disposed axially adjacent, concentric and radially within the conduit and in communication with the outer passage. A paint warming chamber, enclosing the hot air conduit, is provided through which paint flows under pressure towards the paint conduit with the paint warming chamber being enclosed by a wall of a central hot air conduit. A central, annular heating chamber is also provided having perforated walls that communicate with the air conduit and through which the air and paint conduit pass upwardly through the annulus thereof. The air feed conduit and the outer passage surround the entire length of the paint conduit and the inner passage such that the paint is subjected to heating throughout travel along the paint conduit and the inner passage. It should be noted that Roch feeds the material to be sprayed along a tortuous path but does not feed cooling air along a tortuous path in order to maintain the exterior surface of the housing in a relatively cool condition. In the same context, it should also be noted that Roche does not heat the compressed gas as the compressed gas flows along several legs of a serpentine path. It will also be evident from a reading of the Roche patent that there are no provisions for baffle means that divert the heated air away from the exit plane of the nozzle.

U.S. Pat. No. 2,795,461 granted on June 11, 1957, to W. M. Durkin discloses a spray gun comprising an inner liner ,ember that is adapted to hold the material to be sprayed, a barrel portion, an outer container member that is spaced from the inner member and an electrical heating element disposed between the inner and outer members. Means are provided for conveying heat through the inner member to a nozzle. Durkin does not make provision for directing the flow of relatively cool gas along a serpentine path, the first leg of which is defined by the inner surface of the housing in order to maintain the housing in a relatively cool condition, nor does Durkin suggest any means for diverting the flow of hot air away from the exit plane of the nozzle.

In U.S. Pat. No. 2,905,234, granted on Sept. 22, 1959, to H. Scholz, there is disclosed apparatus for the automization and combustion of liquid fuels. There is provided a pre-atomizing chamber and an elongated tubular atomizing chamber that is positioned coaxially in front of the pre-atomizing chamber. A conically converging annular passage is connected to the atomizing and pre-atomizing chambers and means are provided for passing a liquid fuel and an atomizing gas into the pre-atomizing chamber. A tubular member coaxially surrounds the atomizing chamber and defines an annular passage that terminates as a conically converging portion at a burner mouth. A flow guide member conically tapered at its opposite ends surrounds the forward ends of the tubular atomizing chamber and is positioned in said annular passage which defines, with the conically converging portion at the burner mouth, a conically converging annular passage. A second flow guide member having a conically tapered rear and forward end is positioned with its rear end extending into the forward outlet of the atomizing chamber and defining therewith a conically diverging passage with its forward end extending outwardly in the burner mouth. Means are provided for passing an oxidizing gas to the annular passage towards the burner mouth. Means are also provided for heating the wall of the atomizing chamber. In the Scholz patent, water inlet and outlet means are provided in an outer jacket for maintaining the housing in a relatively cool condition. However, it will be noted, that in contrast to the present invention which will be described more fully hereinafter, the cooling material used in the Scholz patent is not used for either heating or carrying the material to be sprayed. Moreover, Scholz does not disclose any means for shielding the nozzle by diverting heated air from the exit plane thereof.

Still another form of prior art which is only somewhat analogous to the present invention is represented by the flameless electric torch manufactured by GTE Sylvania Inc. under part No. SNH-130538. In the Sylvania product there is disclosed an elongated, tubular heating element that is positioned within a housing such that incoming air follows a serpentine path in order to first maintain the housing in a relatively cool condition and then be gradually heated until it reaches its maximum temperature at the interior of the cooling element prior to discharge. While the Sylvania product provides a serpentine path for the incoming gas and does maintain the housing in a relatively cool condition, there is no provision for the admission and discharge of a material such as resin or resin mixture to be heated and sprayed. More specifically, since the Sylvania structure does not contemplate the spraying of a resinous mixture, it does not provide means for shielding the nozzle, from which the resinous mixture would ordinarily be discharged, from the hot gases emanating from the apparatus.

SUMMARY OF THE INVENTION

The present invention provides, in one aspect thereof, a housing having inlet means for compressed air or an inert gas and separate inlet means for the material that is to be sprayed. Outlet means for a mixture of the gas and materials to be sprayed is provided at the opposite end of the housing. A core is positioned concentrically within the housing and is provided with a heating element in the form of a conductor that is adapted to be connected to a suitable source of electrical energy. In the present invention, the incoming compressed air or gas is divided into two streams. The first stream follows a serpentine path, the first leg of which is along almost the entire inside surface of the housing to initially cool and in order to maintain the outside of the housing in a relatively cool condition. The first portion of the compressed air or gas, after traversing the inside surface of the housing, reverses direction and flows along almost the entire length of the apparatus before reversing its direction once again to flow over the entire length of the heating element.

An elongated core, having a plurality of longitudinally extending flutes that define axially oriented and axially spaced apart grooves, provide means for supporting the heating element which is positioned in the grooves. The third and last leg of the first portion of the serpentine path of the compressed air or gas is partially defined by the grooves that receive the heating element so that the compressed air or gas is heated to its desired temperature prior to exiting through the outlet means. A nozzle having a plurality of orifices at one end thereof, and at the other end thereof a tube that is adapted to be connected to a source of the material that is to be sprayed, is positioned concentrically within the core. An annulus is formed between the tube and the bore of the core in order to receive a second portion of the compressed air.

Immediately surrounding the outwardly oriented orifices of the nozzle is a tubular member that directs the second portion of the compressed air or gas in a cylindrical stream about the exterior surface of the nozzle where it functions as a carrier so that the material to be sprayed may mix therewith. Spaced about the tubular member is a concentric shield or baffle that prevents the heated air representing the first portion of the compressed gas from contacting the tubular member and, therefore, from contacting the nozzle so that the heated air mixes with the material to be sprayed and the second portion of the compressed air or gas downstream of the nozzle. This construction prevents "powder balling" and "spitting."

Accordingly, it is an object of the present invention to provide an improved apparatus for spraying heat responsive materials.

It is another object of the present invention to provide an improved apparatus for spraying heat responsive materials, as described above, wherein the outer surface of the apparatus is maintained in a relatively cool condition.

Yet another object of the present invention is to provide an improved apparatus for spraying heat responsive materials, as described above, wherein baffle means are provided for preventing the flow of heated air from encountering the material to be sprayed at the exit of the nozzle.

Still another object of the present invention is to provide improved apparatus for spraying heat responsive materials, as described above, wherein the initially cool compressed air or gas is first used for cooling the exterior surface of the apparatus and then warmed and is used for heating the material to be sprayed.

Yet another object of the present invention is to provide improved apparatus for spraying heat responsive materials as described above, wherein the incoming supply of compressed air or gas is divided into two portions with one of the portions having a dual cooling and then heating function and with a second of the portions being utilized as a carrier for the material to be sprayed.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings.

BRIEF DESCRIPTION OF THE DRAWINGS

In the drawings, wherein the same reference numerals denote the same elements throughout the several views.

DESCRIPTION OF THE PREFERRED EMBODIMENT

Figures 1, 2, 3:
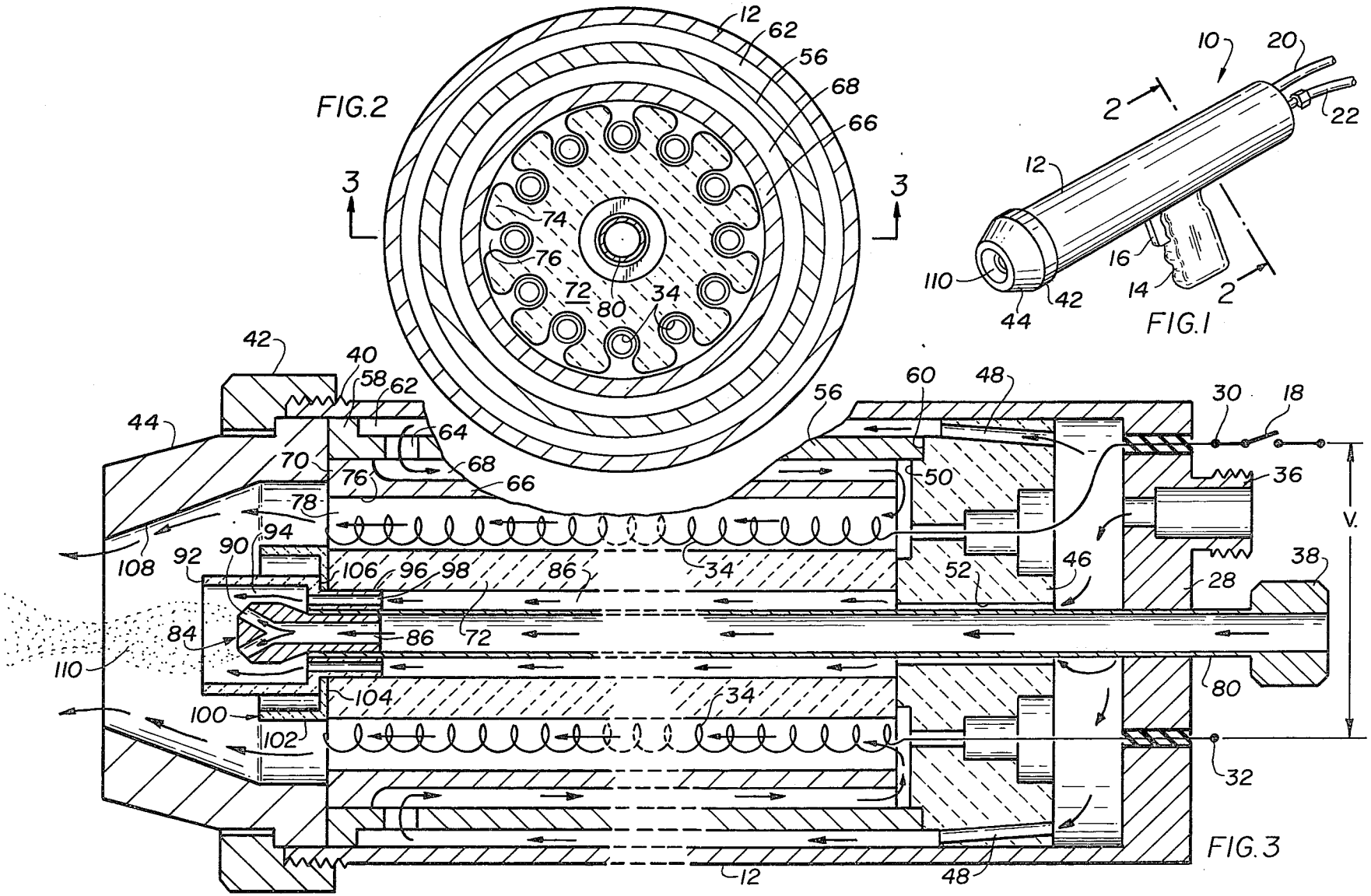
FIG. 1 is a perspective view of the apparatus comprising the present invention.
FIG. 2 is a transverse sectional elevational view taken along line 2—2 of FIG. 1.
FIG. 3 is a longitudinal sectional elevational view taken along line 3—3 of FIG. 2.

The present invention is specifically designed to spray heat responsive materials, such as plastics or resins, either by themselves or with particles entrained therein, such particles being metal, ceramic powder, or the like, although not specifically limited thereto.

The principle of operation of the apparatus comprising the present invention is based on the concept of electrically preheating a compressed fluid as air or inert gas to a controlled temperature, while at the same time injecting a resin in powder form centrally through the apparatus to a point where the compressed air or gas exits from the apparatus in a heated condition. The apparatus is made in the form of a gun that is easily handled and manipulated. As a result of the design of the present invention, the powder, whether in the form of a pure resin or a mixture, is free of contact with any flame. Thus, the present invention is flameless, that is, it does not utilize an open flame that might tend to result in fire or explosion when it is employed in or about combustible articles. As a consequence, the present invention is well adapted for operation in areas such as the hull of vessels and in confined areas wherein open flame cannot be used.

Because of the construction of the present invention, the tendency of plastic or a resinous matrix to char or become degraded is minimized. In the operation of the present invention, the volume of the compressed fluid as air or inert gas may be readily controlled so that the exiting temperature of the gas from the apparatus may also be controlled. In addition, the structure of the present invention causes the gas to follow a tortuous or serpentine path that is designed so as to utilize the initial, relatively cool temperature of the gas in order to cool the exterior surface of the apparatus for ease of handling while thereafter permitting the gas to heat gradually to the desired temperature as it moves through its circuit towards the interior working portions and eventually to the discharge end of the apparatus.

At the point of exit, the temperature of a heated fluid is so controlled as to be below the melting point of the exiting plastic or resinous matrix, thereby minimizing any possibility of the plastic or resinous matrix from softening and adhering to the interior of the apparatus and possibly restricting the flow of plastic or resinous matrix outwardly from the discharge end of the apparatus. As a result, the present invention is free of "powder balling" which often results in structure of this type wherein the resin is heated during its flow through the apparatus. The avoidance of "power balling" consequently minimizes the possibility of contamination of the apparatus which frequently results in "spitting" of the resin as it exits from prior art spray guns.

Referring now to the drawing, and in particular to FIG. 1, there is shown a spray gun 10 comprising the present invention. The spray gun body 10 is generally circular in cross section, but is, of course, not limited to such configuration. The spray gun 10 includes an outer housing 12 and a handle 14. A trigger 16 is used to close a switch 18 (FIG. 3) so that the spray gun 10 may be operated from a conventional electrical power source. As shown in FIG. 1, a conduit 20 is adapted to be coupled to a source of compressed air or an inert gas while a conduit 22 is adapted to be coupled to a remote source of the material that is to be sprayed.

Referring now to FIGS. 2 and 3, it will be seen that the housing 12 is provided with an end wall 28 having feed through electrical terminals 30 and 32 that are electrically connected to a heating element 34 whose structure and function will be described more fully hereinafter. The end wall 28 is further provided with a fitting 36 to which the compressed fluid conduit 20 may be coupled. Similarly, there is a second fitting 38 to which the conduit 22 may be coupled. At its opposite end, the housing 12 is provided with external threads 40 that are engaged by a nut 42 which is used for capturing a discharge head 44.

Inwardly of the housing 12 and downstream of the end wall 28 there if provided a partition wall 46. The heating element 34 is threaded through the partition wall 46 in any suitable manner. The partition wall 46 is further provided with a plurality of generally axially oriented but outwardly flared passageways 48 which are angularly spaced apart in a circumferential direction. A recess 50 is formed on the downstream transverse face of the partition wall 46 and a bore 52 is centrally provided in the partition wall 46.

A first, outer sleeve 56 is provided concentrically within the housing 12. The first sleeve 56 is provided with a radially outwardly directed flange 58 at one end thereof with the outer surface of the flange 58 bearing against the inside surface of the housing 12. The opposite end of the sleeve 56 is seated on a shoulder 60 formed on the downstream transverse end face of the partition wall 46. It will be noted, particularly in FIGS. 2 and 3, that a first annular flow path 62 is defined between the outside surface of the first sleeve 56 and the inside surface of the housing 12. The annular flow path 62 is in fluid communication with the compressed air or inert gas through the openings 48 in the partition wall 46. The outer sleeve 56 is further provided with a plurality of radially oriented openings 64 through the wall thereof proximate the downstream end.

A second, inner sleeve 66 is positioned radially inwardly and concentrically with the outer sleeve 56 so that the inside surface of the sleeve 56 and the outside surface of the sleeve 66 define, in combination, a second annular flow path 68 therebetween. The second sleeve 66 is provided with a radially outwardly extending flange 70 at the downstream end thereof with the flange 70 being in abutment with the inside surface of the first sleeve 56. It will be noted, particularly in FIG. 3, that the second annular flow path 68 is in fluid communication with the recess 50 formed on the downstream transverse end face of the partition wall 46.

Positioned concentrically within the inner sleeve 66 is a heat insulating core generally designated by the reference character 72. The core 72 is provided with a plurality of angularly spaced apart and longitudinally extending flutes 74 that define a plurality of angularly spaced apart and longitudinally extending recesses 76 therebetween. As shown in FIGS. 2 and 3, the heating element 34 is wound back and forth as a single electrical unit through the several grooves 76. It will be further seen in FIG. 3 that the grooves 76 are in fluid communication with the recess 50 formed in the downstream transverse endface of the partition wall 46. Thus, the grooves 76 form a plurality of third flow paths in combination with the inside surface of the second sleeve 66.

It will be appreciated from the foregoing that a first portion of the compressed air or inert gas is first directed to the openings 48 and then through the successive flow paths 62, 68 and 76. Thus, since the compressed air or inert gas is relatively cool when it is first admitted into the body 10, the inside surface of the housing 12 will remain relatively cool. The compressed air or inert gas will be gradually heated as it absorbs and as it flows to and over the heating element 34 in the grooves 76 before it is discharged at the end 78 of the core 72.

The fitting 38 for the resin material to be sprayed may be integrally with a longitudinally extending tube 80 that passes through the end wall 28 of the housing and through the bore 52 of the partition wall 46. The tube 80 also passes through a central bore 82 formed in the core 72 and terminates at its downstream end about the base of a nozzle generally designated by the reference character 84. It will be noted that the bore 52 in the partition wall 46 and the bore 82 in the core 72 form still another linear and longitudinally extending flow path 86 for a cooling second portion of the compressed fluid or air or inert gas.

As may best be seen in FIG. 3, the nozzle 84 is provided with a central bore 88 that is in fluid communication with the interior of the tube 80 and, therefore, with the materials to be sprayed. The central bore 88 of the nozzle 84 terminates at its downstream end in a plurality of outwardly angled orifices 90. A tubular member 92, which may be made of a ceramic or other heat insulating material, is concentrically and spacedly positioned about the outside surface of the nozzle 84 in order to define an annular flow path 94. The tubular member 92 is provided with a neck portion 96 that is received in the bore 82 of the core 72 and includes a plurality of angularly spaced apart and axially oriented openings 98 that are in fluid communication with both the flow paths 86 and the annular flow path 94. Thus, a second portion of the cool compressed air or inert gas flows as a film over the outside surface of the nozzle 84 and entrains therein the particles that are discharged from the orifices 90 of the nozzle 84.

A baffle member generally designated by the reference character 100 is concentrically and spacedly positioned about the tubular member 92. The baffle 100, which may be made of a ceramic or other heat insulating material, is comprised of an axially extending side wall 102 and a transversely extending base wall 104. A transverse seat 106 that is formed between the axially extending side wall of the tubular member 92 and the axially extending neck portion 96 of the tubular member 92 are used to capture the base wall 104 of the baffle 100 between the tubular member 92 and the downstream end of the core 72.

In operation, the side wall 102 of the baffle 100 directs the heated air from the grooves 76 in a generally axial direction and prevents immediate contact thereof with the mixture of the resin particles and the second portion of the compressed air or inert gas that emanates from the orifices 90 of the nozzle 84 and the tubular member 92.

The discharge head 44 may be provided with inwardly tapered bore 108 as shown in FIG. 3. The tapered wall 108, in the embodiment illustrated, starts approximately at the downstream end plane of the baffle member 100. Thus, the heated compressed air or inert gas that is discharged from the grooves 76 at the end 78 thereof is turned inwardly at some point downstream of the baffle member 100 and thereby mixes with the resin material to be sprayed and the second portion of the compressed air or inert gas at a point downstream of and spaced away from the end plane of the tubular member 92. This mixture occurs in a zone area designated 110.

From the foregoing, it will be evident that an improved apparatus for spraying heat responsive materials has been provided.

The present invention includes means that direct a first portion of a stream of compressed air or inert gas along a serpentine path that assures the maintenance of the housing in a relatively cool condition. The compressed air or inert gas is then heated along the last leg of the serpentine path prior to its being discharged and mixed with the combination of the material to be sprayed and the second portion of the compressed air or inert gas. In order to divert the heated air from the tubular member that surrounds the nozzle, a baffle is provided concentrically about the tubular member to constrain the heated compressed air or inert gas along a relatively short, linear, tubular path wherein it can mix with the material to be sprayed and with the second portion of the compressed air or inert gas at a position or in a zone that is downstream of the nozzle.

While there have been shown and described and pointed out the fundamental novel features of the invention as applied to a preferred embodiment thereof, it will be understood that various omissions and substitutions and changes in the form and details of the device illustrated, and its operation may be made by those skilled in the art without departing from the spirit of the invention. It is the invention, therefore, to be limited only as indicated by the scope of the claims appended hereto.

What is claimed is:

1. Apparatus for spraying heat responsive materials, said apparatus comprising:

a housing having inlet means for a compressed fluid comprising air or inert gas and for the material to be sprayed, and outlet means for a mixture thereof;

a core contained in said housing, said core including heat generating means adapted to be connected to a source of electrical energy, said heat generating means being arranged to heat a first portion of the compressed air or inert gas prior to the discharge thereof;

compressed air or inert gas passageway means in said housing and in communication with said inlet means and said outlet means thereof;

nozzle means in communication with said inlet means for the material to be sprayed; and baffle means surrounding said nozzle means for preventing mixing of the heated, compressed air or inert gas and the material to be sprayed until the heated, compressed air or inert gas and the material to be sprayed are downstream of said nozzle means.

2. An apparatus according to claim 1 wherein said baffle means comprises an axially extending side wall, said nozzle means including orifice means positioned radially inward of said side wall and wherein the heated compressed air or inert gas is discharged radially outwardly of said side wall.

3. An apparatus according to claim 2 wherein the axes of said orifice means diverge in the direction of flow of the material to be sprayed and wherein a tubular member is positioned intermediate said nozzle means and said baffle means, said tubular member being in communication with a second portion of the compressed air or inert gas with one end of said tubular member being positioned downstream of said orifice means whereby the material to be sprayed is entrained in the second portion of the compressed air or inert gas and is carried thereby to said outlet means.

4. An apparatus according to claim 3 wherein said tubular member includes a neck portion having a plurality of angularly spaced apart, axially oriented openings therethrough in communication with the second portion of the compressed air or inert gas and wherein said nozzle means includes a central bore in communication with the material to be sprayed and said orifice means whereby the second portion of the compressed air or inert gas flows along a cylindrical path that surrounds the material to be sprayed which is discharged from said orifice means.

5. An apparatus according to claim 3 wherein said housing includes a discharge head having a bore therein defining a mixing chamber with at least a portion of the wall of said bore converging in the direction of flow of the material to be sprayed, said bore being in communication with the first heated portion of the compressed air or inert gas.

6. An apparatus according to claim 5 wherein the wall of said bore converges proximate the plane of the downstream end of said baffle means.

7. An apparatus according to claim 1 wherein said core comprises an axially elongated heat insulating cylinder having a plurality of angularly spaced apart flutes defining longitudinally extending grooves for receiving said heat generating means.

8. An apparatus according to claim 7 wherein there is further included a first inner sleeve encasing said fluted cylinder and said heat generating means and a second outer sleeve spaced from said inner sleeve to define a first inner passageway therebetween for the compressed air or inert gas prior to heating thereof, said second sleeve being spaced inwardly from said housing to define a second outer passageway for the comprised air or inert gas prior to the heating thereof, there being still further included means for providing fluid communication between the source of compressed air or inert gas and said second passageway, between said second and said first passageways and between said first passageway and said grooves in said cylinder.

9. An apparatus according to claim 8 wherein said housing includes a wall at the end thereof opposite said outlet means and means for passing the compressed air or inert gas through said end wall, there being further included a transverse partition wall in said housing intermediate the end of said core that is remote from said outlet means and said end wall of said housing means and wherein said means for providing fluid communication between the source of compressed air or inert gas and said second passageway comprises a plurality of generally axially oriented openings through said partition wall whereby the first portion of the supply of compressed air or inert gas is directed to said second passageway and then against the inside surface of said housing.

10. An apparatus according to claim 9 wherein said partition wall includes a recess on the transverse surface thereof that is adjacent the downstream end of said core, said recess extending between said grooves in said core and said first passageway to thereby define said means for providing fluid communication therebetewwn.

11. An apparatus according to claim 9 wherein there is further included a tube coupled at one end thereof to said nozzle means and adapted to be coupled at the other end thereof to the source of material to be sprayed, said tube extending through said core to define a first annular passageway therebetween and through said partition wall to define a second annular passageway therebetween, said second annular passageway being in fluid communication with said first annular passageway and with the source of compressed air or inert gas whereby a second portion of the compressed air or inert gas may flow over the outer surface of said nozzle means.

12. Apparatus for spraying heat responsive materials from a source, said apparatus comprising:

a source of compressed gas;

an elongated housing having inlet means at one end thereof for receiving compressed gas and the material to be sprayed from said sources and outlet means at the other end thereof for discharging a mixture of the compressed gas in a heated condition together with the material to be sprayed;

first passageway means in said housing in fluid communication with the source of compressed gas and with said outlet means, said first passageway means defining a serpentine path for a first portion of the compressed gas;

means for heating the first portion of the compressed gas in one leg of said serpentine path prior to the discharge thereof;

nozzle means to spray the material therefrom positioned radially inward of said heating means;

means for coupling said nozzle to the source of the material to be sprayed therefrom;

second passageway means for receiving a second portion of the compressed air or inert gas, said second passageway means being arranged to direct a film of compressed gas over the surface of said nozzle means to thereby entrain the material to be sprayed in the second portion of the compressed gas prior to the mixture thereof with the heated, first portion of the compressed gas and subsequent discharge of the heated mixture from said outlet means; and baffle means surrounding said nozzle means to prevent the mixing of said heated first portion of the compressed gas with said material-entrained second portion until the latter is downstream of said nozzle means.

13. An apparatus according to claim 12 wherein said first passageway means comprises means for directly receiving and directing the first portion of the compressed air or inert gas against the inside surface of said housing whereby the exterior surface of said housing is maintained in a relatively cool condition.

14. An apparatus according to claim 12 wherein said first passageway means comprises a cylindrical heat insulating core having a plurality of angularly spaced apart flutes on the outside surface thereof, said flutes defining a plurality of angularly spaced apart, longitudinally extending grooves that comprise a first leg of said serpentine path, said grooves being arranged to receive said heating means whereby the compressed gas flows over and is heated by said heating means prior to being discharged from said outlet means.

15. An apparatus according to claim 14 wherein said serpentine path further comprises a second, inner leg adjacent the inside surface of said housing for initially receiving said first portion of the compressed gas from said inlet means therefor, said second leg of said serpentine path being defined by the inside surface of said housing, by the outside surface of said outer sleeve that is spaced radially inwardly from the inside surface of said housing, the wall of said first sleeve having a plurality of openings therethrough proximate the downstream end thereof, said serpentine path being further comprised of a third annular leg defined by the inside surface of said outer sleeve and the outside surface of said radially inner sleeve, the direction of flow through said third leg being opposite to the direction of flow through said first and said second legs.

16. An apparatus according to claim 15 wherein said nozzle means includes a plurality of outwardly angled orifices, there being further provided a cylindrical, tubular member surrounding said nozzle and having openings in fluid communication with said second passageway means whereby the second portion of the compressed air or inert gas is used as a carrier for the material to be sprayed.

17. An apparatus according to claim 16, said baffle means comprising a cylindrical baffle surrounding said tubular member for preventing mixing of the heated, compressed gas and the material to be sprayed until the heated, compressed gas and the material to be sprayed are downstream of said nozzle means.

18. An apparatus according to claim 17 wherein said housing includes an end cap having a bore therein defining a mixing chamber with at least a portion of the wall of said bore converging in the direction of flow of the material to be sprayed, said bore being in fluid communication with the first, heated portion of the compressed gas.

19. An apparatus for spraying heat responsive resin materials comprising:

a pressurized source of heat responsive resin materials;

a source of compressed fluid;

a body;

a passage in said body connected with said pressurized source of material to receive the same and a nozzle to spray the same from said body, inlet means on said body connected with said source of compressed fluid to direct the flow of one portion of the fluid through said body initially to cool the outer portion thereof and to direct the flow of another portion of the fluid through said body to cool said passage, heating means in said body to heat the one portion of fluid during its flow, and means on said body directing each of said portions of fluid downstream of said nozzle, said means directing said heated portion of the fluid to heat the resin material and directing said other portion of the fluid so as to prevent the heating of the resin material by said heated portion until the resin material is downstream of said nozzle.

* * * * *

UNITED STATES PATENT OFFICE

CERTIFICATE OF CORRECTION

Patent No. 4,065,057 Dated December 27, 1977

Inventor(s) George J. Durmann

It is certified that error appears in the above-identified patent and that said Letters Patent are hereby corrected as shown below:

Claim 8, line 8, change "comprised" to --compressed--

Claim 10, lines 6 and 7, change "therebetwwn" to --therebetween--

Claim 12, line 20, after "nozzle" insert --means--

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*